United States Patent [19]

Zurecki

[11] Patent Number: 4,770,697

[45] Date of Patent: Sep. 13, 1988

[54] BLANKETING ATMOSPHERE FOR MOLTEN ALUMINUM-LITHIUM ALLOYS OR PURE LITHIUM

[75] Inventor: Zbigniew Zurecki, Allentown, Pa.

[73] Assignee: Air Products and Chemicals, Inc., Allentown, Pa.

[21] Appl. No.: 925,652

[22] Filed: Oct. 30, 1986

[51] Int. Cl.[4] ..... C22B 21/00; B22D 11/00

[52] U.S. Cl. ..... 75/68 R; 420/528; 164/66.1; 164/68.1; 164/475

[58] Field of Search ..... 164/66.1, 67.1, 68.1, 164/259, 415, 475; 75/68 R; 420/528

[56] References Cited

U.S. PATENT DOCUMENTS

| | | | |
|---|---|---|---|
| 3,467,167 | 9/1969 | Mahin | 164/56 |
| 3,484,232 | 12/1969 | Karinthi et al. | 75/45 |
| 3,640,702 | 2/1972 | Karinthi et al. | 75/59 |
| 4,200,138 | 4/1980 | Hildebrandt | 164/66 |
| 4,248,630 | 2/1981 | Balmath | 75/135 |
| 4,389,240 | 6/1983 | Erich et al. | 75/0.5 B |
| 4,402,741 | 9/1983 | Pollet et al. | 75/68 R |
| 4,522,784 | 6/1985 | Enright et al. | 420/590 |
| 4,532,106 | 7/1985 | Pickens | 420/528 |
| 4,534,807 | 8/1985 | Field et al. | 148/20.3 |
| 4,556,535 | 12/1985 | Bowman et al. | 420/580 |
| 4,582,118 | 4/1986 | Jacoby et al. | 164/475 |

FOREIGN PATENT DOCUMENTS

| | | | |
|---|---|---|---|
| 59-19507 | 2/1984 | Japan . | |
| 2129345 | 5/1984 | United Kingdom | 164/475 |
| 1124540 | 6/1986 | United Kingdom | 75/68 R |
| 722978 | 10/1978 | U.S.S.R. . | |
| 697252 | 11/1979 | U.S.S.R. | 164/66.1 |

OTHER PUBLICATIONS

Aluminum-Lithium Alloys II, Second International Al-Li Conference, 1983, pp. 657-673.

"Phase Composition of Surface Films on Al Alloys with Li.", Tarasenko et al., UDC 669.71'884:539.216.2, American Society for Metals.

"Casting Problems Specific to Al-Li Alloys", Divecha et al., Metallurgical Society/AIMF.

*Primary Examiner*—Nicholas P. Godici
*Assistant Examiner*—Richard K. Seidel
*Attorney, Agent, or Firm*—Willard Jones, II; James C. Simmons; William F. Marsh

[57] ABSTRACT

Blanketing of molten aluminum-lithium alloys is performed under a nontoxic and noncorrosive dichlorodifluoromethane containing gas atmosphere, which produces a thin self-passivating fluxing film on the melt surface. The blanketing atmosphere protects the melt from oxidation, burning, and lithium evaporation, improves alloy cleanliness and can be used in any furnace, transfer or casting operation. The blanketing atmosphere can be applied in the entire range of commercial or master aluminum-lithium alloys including pure lithium melts. The dichlorodifluoromethane concentration in the blanketing atmosphere can range from 0.05 to 100 vol % with the remainder being an inert gas such as argon.

20 Claims, No Drawings

BLANKETING ATMOSPHERE FOR MOLTEN ALUMINUM-LITHIUM ALLOYS OR PURE LITHIUM

FIELD OF THE INVENTION

This invention relates to the production of aluminum-lithium alloys, and more particularly to the protective atmospheres for the operations of melting, holding, alloying, stirring, degassing, mold casting, and direct chill casting of aluminum-lithium alloys.

BACKGROUND OF THE INVENTION

The production of aluminum-lithium alloys has become of commercial interest, due to the combination of mechanical properties and light weight which these alloys exhibit. Unfortunately, molten aluminum-lithium alloys are very reactive with air which makes their production and fabrication correspondingly difficult.

The surface of an Al-Li bath reveals chemical behavior of molten lithium rather than aluminum thus causing the bath to: (1) burn on contact with air thus forming an excessive dross layer with the generation of toxic fumes resulting in poor lithium recovery and hazardous work conditions; (2) attract hydrogen from the atmosphere, including traces of water vapor, which increases hydrogen absorption and results in higher porosity levels and a loss of the desired mechanical properties; and (3) become practically unskimmable thus preventing proper stirring and degassing of the melt since any disruption of the generated dross will increase the rate at which further quantities of dross are formed. To overcome these enumerated difficulties, several solutions have been offered in the literature.

U.S. Pat. No. 4,248,630 discloses a process for adding alloying elements, including highly reactive metals such as lithium, to molten aluminum so that normally occurring oxidation reactions of such elements with the atmosphere is minimized. Basically, the process requires that all other alloying elements except lithium be added to the molten aluminum and the melt be degassed and filtered. Upon completion of the degassing/filtering step, the lithium is introduced into a mixing crucible as the final step prior to casting. The desired concentration of the lithium is achieved by controlling the relative amount of lithium and the alloyed melt. Uniformity of the mixture is achieved by mechanical stirring. The mixing crucible and all other crucibles in which lithium may be present are kept under an argon blanket.

U.S. Pat. No. 4,556,535 discloses a process for forming aluminum-lithium alloys which comprises continuously monitoring the ingot casting rate and continuously adding a measured and controlled amount of molten lithium beneath the surface of the molten aluminum stream as it flows to the ingot casting station. At the contact location of the lithium and aluminum, a mixture of argon and chlorine and/or other inert and reactive fluxing gases is injected through a vaned, rotating dispenser. The patent further discloses that the introduction of the lithium into the aluminum must be below the surface of the aluminum in order to minimize the occurrence of oxidation, fuming and hydrogen absorption.

Both U.S. Pat. Nos. 4,248,630 and 4,556,535 counterbalance the detrimental effects of lithium reactivity by means of minimizing time between the alloying and casting, however, neither process deals effectively with the problems of submerged injection of a premelted lithium charge, inert blanketing, lithium evaporation and melt hydrogen pick-up. Both systems suffer from the lack of proper melt surface protection for inert gas bubbling and handling operations.

Batch processes utilizing molten salt fluxes are an alternative to the continuous systems, discussed above, which are expensive and inflexible in operation, particularly when operating ranges or alloy changes are required. These fluxes, which are comprised primarily of lithium chloride or lithium fluoride, are applied to the surface of the lithium containing bath whereby they eliminate a part of the problem related to the lithium reactivity and still achieve a lithium recovery of approximately 80 wt %. Unfortunately, disruptions in the bath surface whether by stirring or degassing or any other movement in the bath breaks the flux layer and exposes the metal to ambient air resulting in violent oxidation of the lithium. Also, fluxes are highly corrosive to the refractory linings of the furnace and related casting equipment and materials of construction. The fluxes are also known to deteriorate the metal cleanliness and contaminate the environment as well as the equipment including melting, mixing, holding, and alloying furnaces, metal transfer troughs, casting stations, direct-chill liners and molds. Difficulties associated with storage and handling of the fluxes frequently cause a carry over of moisture into the aluminum-lithium melt and the subsequent oxidation and hydrogen pick-up.

Other solutions such as blanketing with a pure dry inert atmosphere eliminate the flux method drawbacks, however, these require tightly enclosed pots and troughs and therefore are not flexible enough to be used in various stages of aluminum-lithium fabrication. Furthermore, inert atmosphere blanketing does not decrease lithium evaporation from the bath, which results in substantial lithium losses and creates a potential hazard. Inert atmosphere blanketing does not provide flux layer cleaning properties such as preventing the hydrogen just removed from the bath during degassing from freely back-diffusing into the uncovered alloy, and/or allowing nonmetallic inclusions which have moved to the bath surface during inert gas stirring to be intercepted by the flux layer.

SUMMARY OF THE INVENTION

The present invention is a protection process for use in melting, holding, alloying, stirring, degassing, melt transfer and casting processes for molten aluminum-lithium alloys or lithium. The process of the present invention comprises blanketing the top of a molten aluminum-lithium alloy or lithium bath with an effective amount of a nontoxic, reactive, dichlorodifluoromethane containing, gas atmosphere. The dichlorodifluoromethane reacts with primarily the lithium in the melt and rapidly forms a thin fluxing layer on the surface of the bath. This thin layer prevents oxidation of the melt, hydrogen absorption into the melt, and the formation of a heavy dross layer; the thin layer is easily skimmed from the surface if necessary. The layer develops even if not all of the ambient air is evacuated from above the melt.

Alternatively, other substitute blanketing atmospheres containing an effective amount of a halogen compound having at least one fluorine atom and one other halogen atom selected from the group consisting of chlorine, bromine and iodine, or an atmosphere comprising fluorine or a fluorine-containing compound and one other halogen or halogen-containing compound wherein said halogen is selected from the group consisting of chlorine, bromine and iodine will work in the process of the present invention. The use of these alternative atmospheres would result in the same protective layer.

DETAILED DESCRIPTION OF THE PRESENT INVENTION

The present invention is a process for protecting an alloy which comprises aluminum and lithium or pure lithium which uses a nontoxic, noncorrosive, dichlorodifluoromethane containing, gas blanketing atmosphere, which inerts and fluxes the surfaces of melt. Preferably the nontoxic, noncorrosive, dichlorodifluoromethane containing, gas blanketing atmosphere is comprised of dichlorodifluoromethane and an inert gas, e.g. argon.

Basically, the $CCl_2F_2$/Ar blanketing blend is applied to the molten aluminum-lithium alloys during the melting, holding, alloying, stirring, degassing, melt transfer and casting processes. As a result of the application the $CCl_2F_2$ reacts with the alloy forming a passivating and self-healing viscous liquid layer which protects the metal from oxidation, burning, hydrogen and/or moisture pick-up, hydrogen back-diffusion, and lithium loss due to an evaporation effect. The formed liquid layer can be skimmed without harm to the metal if the process requires a reactive gas bubbling skimming operation for degassing and/or inclusion removal. Thus, both an inerting and fluxing benefit is achieved.

The $CCl_2F_2$/inert gas blend should be applied to the molten aluminum bath while the lithium is introduced into aluminum or at any later moment or stage of the aluminum-lithium melt processing. The gas blend (atmosphere) may also be contained above a pure lithium melt as well.

$CCl_2F_2$ concentration in the blend may be varied in the range of 0.05 to 100 vol %; the result being the higher the $CCl_2F_2$ concentration the higher the rate at which the resultant fluxing film is formed. The application of a 100% by volume $CCl_2F_2$ atmosphere over the melt will not cause any hazardous conditions. A 0.05–5.0 volume % $CCl_2F_2$ concentration in the inert gas is preferred. The inert gas can be chosen from the group consisting of Ar, He, etc. Since nitrogen is slightly reactive and nonprotective to both lithium and aluminum and nitrogen will cause deterioration in melt cleanliness, in those instances where melt cleanliness is not a paramount concern, nitrogen can be used as the inert gas.

The dichlorodifluoromethane could be replaced by other reactive gases. These other reactive gases of the blend can consist of any combination of chlorine and fluorine bearing gases. It is believed that fluorine only initiates the passivating reaction and the amount of fluorine in the reactive gas need not exceed the amount of chlorine. Under a predominantly fluorine atmosphere, the metal-gas reaction may become uncontrolled and result in burning. The chlorine of the reactive gas may be substituted by bromine or iodine. Any molecular combination of the above gas elements which may include other elements such as carbon or sulfur, can be utilized in blanketing of the aluminum-lithium alloys or other reactive metals, however, any preferred embodiment should produce a nontoxic gas. Any toxicity of the reactive gas will significantly limit the applicability of the blend in foundry operations.

The $CCl_2F_2$/inert gas blend is useable for the entire range of aluminum-lithium alloys and aluminum-lithium master alloys up to 100% wt of lithium. The blend is not, however, recommended for pure aluminum melts, since its specific protective and fluxing properties are manifested only in presence of lithium.

Although not being held to any particular theory as to why the present invention should work, the most likely explanation is that in certain temperature ranges, lithium chloride passivates lithium exposed to chlorine and aluminum fluoride passivates aluminum exposed to fluorine, and carbon may further enhance the molten metal protection effect. To further the explanation, $CCl_2F_2$ is thermally stable and inert at temperatures exceeding those of molten aluminum-lithium production. When exposed to the highly reactive and molten lithium containing alloy surface, the $CCl_2F_2$ gas enters into a series of chemical reactions resulting in a complex lithium chloride and lithium fluoride containing layer. Traces of oxygen and lithium oxide, present at the melt surface, are combined together into a lithium carbonate product. Of these, lithium chloride and lithium carbonate are liquid and lithium fluoride and lithium oxide are solid at normal bath temperature. Besides, lithium chloride and lithium carbonate are characterized by a Pilling-Bedworth ratio of more than one, which means, that their layer is compact and once formed will hinder diffusion of reactants in either direction. Therefore, lithium chloride and lithium carbonate, as well as lithium bromide or iodide and unlike lithium oxide, fluoride or nitride will form a self-passivating layer. Aluminum of the aluminum-lithium melt is far less reactive than lithium and having a much larger atomic radius has a lower diffusivity. Yet, part of the aluminum may react with the $CCl_2F_2$ and of the resultant aluminum chloride or fluoride, only the latter is protective in terms of a Pilling-Betworth ratio. It is believed that the non-protective lithium fluoride and the protective aluminum fluoride will combine to form complex viscous particles, $Li_3AlF_6$. This cryolite type compound, together with lithium chloride and lithium carbonate passivate the melt surface to the point at which it is impermeable to the gaseous or metallic ions. The passivation process is quick and the resultant surface layer is thin and compact. Formation of the non-protective, and gaseous at the aluminum-lithium melt temperature, aluminum chloride is therefore not only unfavored but also kinetically hindered. A further inspection of thermodynamic properties of the involved compounds shows that only fluorine can replace oxygen from thin lithium oxide and aluminum oxide films, which will always be present at the melt surface in a foundry environment. It is concluded that fluorine atoms are necessary to initiate the blanketing reaction, chlorine, bromine or iodine atoms provide material for the lithium layer passivation and carbon plays a secondary role by scavenging lithium oxide and oxygen into a passivating lithium carbonate component of the protective layer.

Although the mechanism of $CCl_2F_2$ blanketing is speculative, aluminum-lithium and lithium melts are well protected by the $CCl_2F_2$ originated layer. In order to demonstrate the efficacy of the present invention the following examples were run.

EXAMPLES

EXAMPLE 1

A well stirred molten aluminum-3% lithium alloy was held under a cold transparent lid at 1300° F. The lid became coated with a thick metallic deposit after less than ½ hour if the furnace headspace were filled with argon.

A blend of 5 vol % $CCl_2F_2$ in argon gas blend was then introduced into the headspace. The result was that a thin viscous transparent liquid layer was formed on the melt surface. No deposits were found on the lid.

Then a measured amount of ambient air, i.e. containing some water vapor, was mixed with the $CCl_2F_2$/Ar blend and introduced into the headspace to simulate disturbances in the blanketing process which may occur during casting operations in a typical foundry environment. The result was that a thin viscous transparent liquid layer was formed along with a powdery graphite deposit over the molten metal surface. When the metal surface was mechanically skimmed to remove the formed viscous transparent layer, the freshly exposed metal was shiny and unoxidized. The metal surface became dull and oxidized, when concentration of air in the blend exceeded 25 vol %.

Then the $CCl_2F_2$ concentration in the $CCl_2F_2$/Ar blend was increased to 100% vol. The increasing $CCl_2F_2$ concentration resulted in an increase of rate at which the thin transparent liquid layer was formed. No burning, fuming and deposits on the cold lid occurred and no HF, HCl, CO, and $CO_2$ emissions were detected throughout the entire testing.

EXAMPLE 2

The $CCl_2F_2$ component of the $CCl_2F_2$/Ar blend was replaced by other nontoxic reactive gas, i.e. sulfur hexafluoride, which molecules contained fluorine but not chlorine atoms. This gas when tested on pure aluminum melts produced thin elastic surface skins. The modified blend was introduced into the aluminum-lithium furnace headspace and the tests of Example 1 were repeated. The blend produced a thick and lumpy unskimmable dross unless the reactive gas concentration in argon exceeded 4 vol % and when this concentration was exceeded the aluminum-lithium melts burned progressively increasing the metal bath temperature. Any additions of air into the blend were found to facilitate the ignition and intensify burning and fuming.

EXAMPLE 3

A pure lithium bath was blanketed with $CCl_2F_2$ resulting in a liquid transparent layer and small amount of a powdery graphite coating on the surface of the melt. When the test was repeated with the reactive gas of Example 2, violent burning of the bath resulted.

EXAMPLE 4

The tests presented in examples #1 and #2 were repeated for aluminum-lithium alloys which contained 1.7 and 4.0 wt. % of lithium and for an increased temperature regime of 1420° F. The test results were the same as those previously noted.

As can be seen from these Examples, the process of the present invention accomplishes the formation of protective, self-passivating and self-healing thin liquid layer over the surface of molten aluminum-lithium alloys, master alloys and pure lithium, which can protect the metal from oxidation, burning, hydrogen pick-up and back-diffusion, and lithium evaporation from the melt during melting, holding, alloying, mixing or stirring, degassing, melt transfer, and casting operations. The process facilitates the formation of a thin and skimmable flux layer, which can actively participate in the aluminum-lithium melt cleaning operations and does not require application of salts, that are corrosive to the fabrication equipment and contaminate molten metal, equipment, and the environment. The nontoxic protective and treatment atmosphere for molten aluminum-lithium alloys which can be applied during casting or any molten metal treatment or transfer where a gas outleak is possible is safe, eliminates any fire hazards and performs even in the presence of air or water vapor impurities.

The present invention has been described with reference to several preferred embodiments thereof. However, these embodiments should not be considered a limitation on the scope of the invention, which scope should be ascertained by the following claims.

I claim:

1. In a process for protecting an alloy which comprises aluminum and lithium in a molten state by blanketing the molten alloy, the improvement comprising carrying out the blanketing utilizing an atmosphere containing an effective amount of a halogen compound having at least one fluorine atom and one other halogen atom selected from the group consisting of chlorine, bromine and iodine and wherein the ratio of flourine to the other halogen atom in the halogen compound is less than or equal to one, whereby a passivating and self-healing viscous liquid layer is formed which protects the molten alloy from lithium loss due to vaporization, oxidation of the molten alloy, and hydrogen pick-up by the molten alloy.

2. The process of claim 1 wherein said other halogen atom is chlorine.

3. The process of claim 1 wherein said other halogen atom is bromine.

4. In a process for protecting an alloy which comprises aluminum and lithium in a molten state by blanketing the molten alloy, the improvement comprising carrying out the blanketing utilizing an atmosphere containing an effective amount of dichlorodifluoromethane, whereby a passivating and self-healing viscous liquid layer is formed which protects the molten alloy from lithium loss due to vaporization, oxidation of the molten alloy, and hydrogen pick-up by the molten alloy.

5. The process of claim 4 wherein said dichlorodifluoromethane containing atmosphere is a mixture of dichlorodifluoromethane and an inert gas.

6. The process of claim 5 wherein said inert gas is selected from a group consisting of argon, helium or mixtures thereof.

7. The process of claim 5 wherein dichlorodifluoromethane comprises from 0.05 to 5.0 volume percent of said mixture.

8. The process of claim 5 wherein dichlorodifluoromethane comprises from 0.05 to 5.0 volume percent of said mixture and said inert is selected from the group consisting of argon, helium and mixtures thereof.

9. The process of claim 4 wherein said dichlorodifluoromethane containing atmosphere is a pure dichlorodifluoromethane.

10. In a process for protecting molten lithium by blanketing the molten lithium, the improvement comprising carrying out the blanketing utilizing an atmosphere containing an effective amount of dichlorodifluoromethane, whereby a passivating and self-healing viscous liquid layer is formed.

11. The process of claim 10 wherein said dichlorodifluoromethane containing atmosphere is a mixture of dichlorodifluoromethane and an inert gas.

12. The process of claim 11 wherein said inert gas is selected from a group consisting of argon, helium or mixtures thereof.

13. The process of claim 11 wherein dichlorodifluoromethane comprises from 0.05 to 5.0 volume percent of said mixture.

14. The process of claim 11 wherein dichlorodifluoromethane comprises from 0.05 to 5.0 volume percent of said mixture and said inert is selected from the group consisting of argon, helium and mixtures thereof.

15. The process of claim 10 wherein said dichlorodifluoromethane containing atmosphere is a pure dichlorodifluoromethane.

16. In a process for protecting an alloy which comprises aluminum and lithium in a molten state by blanketing the molten alloy, the improvement comprising carrying out the blanketing utilizing an atmosphere containing an effective amount of fluorine or a flourine-containing compound and an effective amount of one other halogen or halogen-containing compound wherein said halogen is selected from the group consisting of chlorine, bromine and iodine and wherein the ratio of flourine to the other halogen in the atmosphere is less than or equal to one, whereby a passivating and self-healing viscous liquid layer is formed which protects the molten alloy from lithium loss due to vaporization, oxidation of the molten alloy, and hydrogen pick-up by the molten alloy.

17. The process of claim 16 wherein said other halogen atom is chlorine.

18. The process of claim 16 wherein said other halogen atom is bromine.

19. A process for protecting an aluminum-lithium alloy during melting, casting and fabrication of wrought shapes by enveloping the exposed surfaces with an atmosphere containing an effective amount of a halogen compound having at least one flourine atom and one other halogen atom selected from the group consisting of chlorine, bromine and iodine and wherein the ratio of fluorine to the other halogen atom in the halogen compound is less than or equal to one, whereby a passivating and self-healing viscous liquid layer is formed which protects the alloy from lithium loss due to vaporization, oxidation of the alloy, and hydrogen pick-up by the alloy.

20. The process of claim 19 wherein said halogen compound is dichlorodifluoromethane.

* * * * *